US006049918A

United States Patent [19]

White, Sr.

[11] Patent Number: 6,049,918

[45] Date of Patent: Apr. 18, 2000

[54] TOILET BOWL CLEANING SYSTEM

[76] Inventor: Bill J. White, Sr., 815 Plum Branch Rd., Edgefield, S.C. 29824

[21] Appl. No.: 09/228,100

[22] Filed: Jan. 11, 1999

[51] Int. Cl.[7] ..... E03D 9/02

[52] U.S. Cl. ..... 4/222

[58] Field of Search ..... 4/222, 253, 255.01, 4/666; 134/24

[56] References Cited

U.S. PATENT DOCUMENTS

| | | | |
|---|---|---|---|
| 2,894,763 | 7/1959 | Kunkel et al. | 4/661 X |
| 3,480,021 | 11/1969 | Ewald, Jr. | 4/255.01 X |
| 4,112,527 | 9/1978 | Giubilo | 4/295 |
| 4,137,577 | 2/1979 | Maxfield | 4/231 |
| 5,308,405 | 5/1994 | McElroy | 134/24 |

FOREIGN PATENT DOCUMENTS

| | | | |
|---|---|---|---|
| 3622134 | 1/1988 | Germany | 4/222 |

*Primary Examiner*—Charles E. Phillips

*Attorney, Agent, or Firm*—Hardaway/Mann IP Group

[57] ABSTRACT

A stopper mechanism 10 having a base 20 with a gasket 50 area to be placed within the drain opening 30 of a toilet bowl 40. The stopper mechanism 10 also has an overflow pipe 60 having a handle 66 and being connected to the base 20. At least two rotatable arms 70 are connected to the overflow pipe 60 which can be rotated outward to lock with the rim 80 of the toilet bowl 40 and secure the stopper mechanism 10 in place thus preventing it from moving when the toilet bowl 40 is filled with water. Once the stopper mechanism 10 is secured in place, the toilet bowl 40 is filled with water up to the rim 80. A cleaning solution 120 is then added to the water in the toilet bowl 40 and allowed to remain for a desired length of time soaking and cleaning the toilet bowl 40 as it sits.

3 Claims, 2 Drawing Sheets

TOILET BOWL CLEANING SYSTEM

BACKGROUND OF THE INVENTION

1. Field of the Invention

This invention relates to the art of toilet bowl cleaning systems, and more specifically to a system wherein the drain in the toilet bowl is sealed off so the water level in the toilet bowl raises to a preferred level and cleaning solution is added to the water hence cleaning the bowl.

2. Description of Prior Art

While there are many ways to clean a toilet bowl, most of them involve a person scrubbing with a brush or by hand the toilet bowl. These methods may be effective, but they also require the person cleaning the bowl to place their hands in the bowl and also get them wet and covered with toilet bowl water. Also, the way toilet bowls work, a certain level of water is maintained in the toilet bowl. At the edge of the water level, dirt and stains can accumulate, which are difficult to remove and give the appearance of an unkept toilet bowl.

One method of cleaning toilet bowls that does not require the person cleaning the toilet bowl to submerge their hands into the toilet bowl is a method of covering the drain inside the toilet bowl so that water builds up within the toilet bowl and adding some kind of cleaning solution or agent and allowing it to remain in the toilet bowl thereby reducing the dirt and grime within the toilet bowl. The person cleaning the bowl can then brush the bowl or simply flush it, allowing it to rinse itself out.

There are many ways of accomplishing the aforementioned cleaning systems, a few of which are disclosed in the U.S. patents issued to Maxfield and McElroy, also the U.S. patent issued to Giubilo shows a device for covering a toilet bowl drain.

The patent issued to Don Maxfield, U.S. Pat. No. 4,137,577 entitled "Toilet Bowl Cleaning Device" discloses a plug member which is placed in the bottom of a toilet bowl and one end of a flexible tube is attached thereto. At the opposite end of the flexible tube is a block of water soluble material carrying a cleanser. The plug member and flexible tube are water soluble with the plug member carrying a cleanser. As the plug and block dissolve, they release the cleanser into the water in the bowl which helps to clean the toilet bowl. As the block member dissolves, it allows the flexible tube to fall into the toilet bowl. As the plug member dissolves, it allows the flexible tube to be flushed down the toilet. A drawback of the Maxfield system is that it takes a long time for the block and plug to dissolve. Also, the tube has to be flushed into the system. Another drawback is that the system is not reusable, a new block, tube and plug must be used for every cleaning. The amount of time it takes to use the presently claimed system effectively can be determined and controlled by the person cleaning the toilet bowl. The presently claimed invention is also reusable and easy to store.

The patent issued to John McElroy, U.S. Pat. No. 5,308,405, entitled "Toilet Bowl Cleaning System" shows a system having a stopper tool that is held in place over the toilet bowl drain and holding the flush handle until the water fills to the top of the bowl. A cleaning agent is then added to the water in the toilet bowl. The stopper tool is then removed from the toilet bowl and the toilet is flushed to rinse and clean the toilet bowl. A disadvantage of the McElroy cleaning system is that the flush handle must be held down until the desired water level is reached in the toilet bowl and also the stopper tool must be held in place while the toilet bowl is filling with water. The presently claimed invention does not require the flush handle to be held in place, nor does it require a stopper to be held in place in the toilet drain until the toilet bowl is filled with water. Once in place, the presently claimed invention is hands free to the person cleaning the toilet bowl.

The U.S. patent issued to Lauro Giubilo, U.S. Pat. No. 4,112,527, entitled "Temporary Stopper For Outlets Of Toilet Bowls" shows a stopper mechanism that can be placed in the drain in a toilet bowl while a handle, that is connected to the stopper through a Spring mechanism, is placed under the lip of the toilet bowl to keep the stopper in place. Decompressing the spring to place the handle in place can take some strength and energy and the process must be repeated to remove the stopper from the toilet bowl. The presently claimed invention is easy to install and no exorbitant amount of strength or energy are required or necessary to install and remove it from the toilet bowl.

SUMMARY OF THE INVENTION

It is an object of this invention to provide a simple and easy mechanism for cleaning toilet bowls.

It is also an object of the present invention to provide an over flow mechanism so as to prevent overflowing of the toilet bowl.

Yet another object of this present invention is to have a stopper that will be held in place as the toilet bowl fills with water without the aid of a person.

And another object of the present invention is to provide a cleaning system that is easily installed, used and removed from the toilet bowl without requiring a lot of strength or energy on the part of the user.

It is still a further object of the present invention to provide a toilet bowl cleaning system that is reusable and easy to store when not in use.

The aforementioned objectives will be accomplished as well as other features and advantages of the present invention will become more apparent from the following detailed description. The description of the present invention discloses, in conjunction with the drawings which illustrate by way of example, the principles and of the invention. Such objectives are satisfied by the presently claimed toilet bowl cleaning system that is comprised of a stopper mechanism having a base with a gasket which is connected to a central overflow pipe having a handle on the top thereof. Hingedly connected to the lower part of the overflow pipe are at least two, possibly more, arms. When in storage, and for removal from the toilet bowl, the arms are held in place adjacent to the overflow pipe by clip elements attached to the upper portion of the overflow pipe. While in use, the arms are rotated until they are removably connected to rest or abut the rim of the toilet bowl.

DETAILED DESCRIPTION OF THE INVENTION

The presently claimed toilet bowl cleaning system includes a stopper mechanism 10 and a cleaning solution or agent 120. The cleaning solution 120 can be any commonly known or used solution and may be either in a liquid or solid form.

Figure 1:
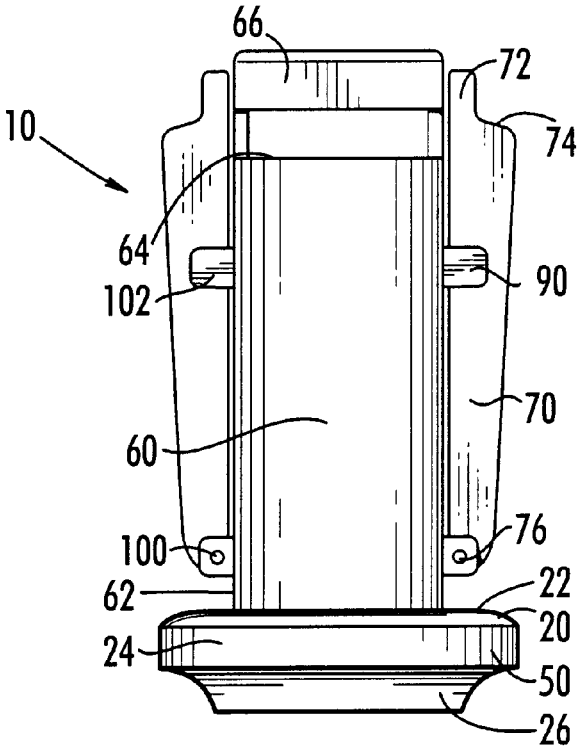
FIG. 1 is a side elevation view of the toilet bowl cleaning system.
Figure 3:
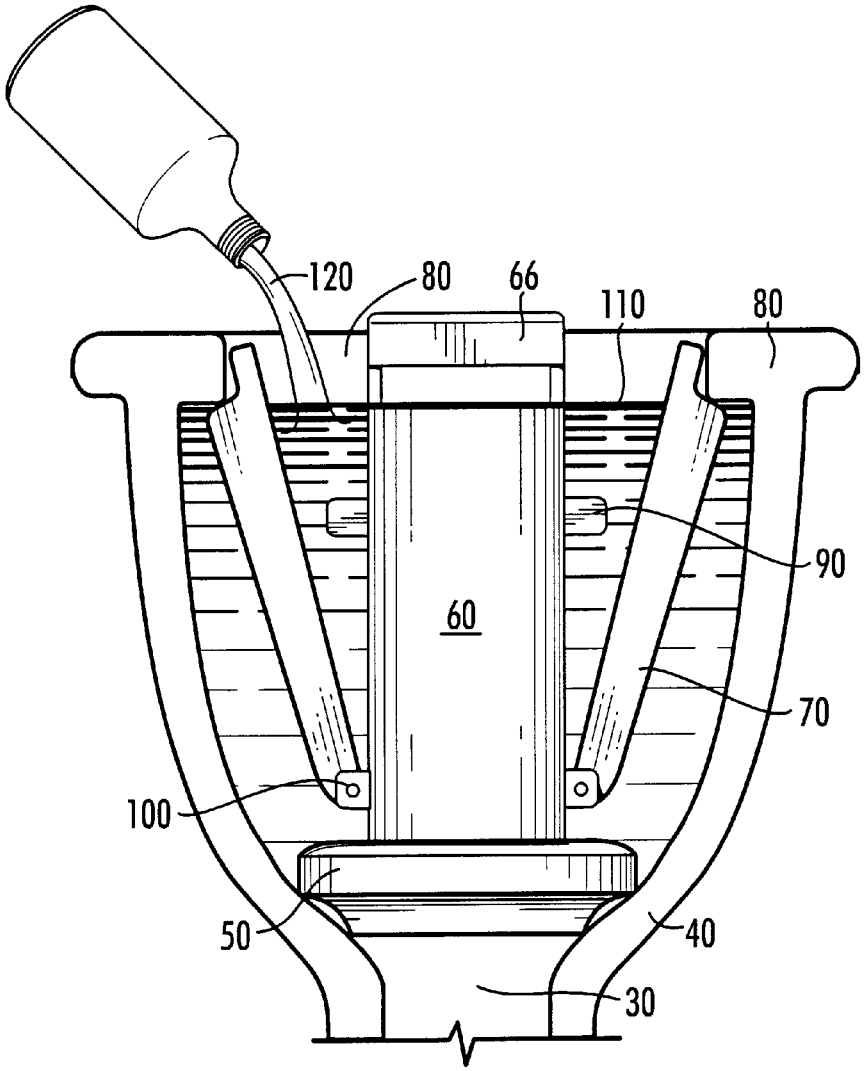
FIG. 3 is a broken-away side elevation view showing the toilet bowl cleaning system in use in a toilet bowl.

FIG. 1 is a perspective view of the stopper mechanism 10. The stopper mechanism 10 is comprised of a base 20 having a top portion 22, a middle portion 24 and a bottom portion 26. The base 20 has a circular cross-section and the top portion 22 has a larger diameter than the bottom portion 26. The bottom portion 26 is contoured to fit snugly within the drain opening 30 in the bottom of a toilet bowl 40. The middle and bottom portions 24, 26 of the base 20 comprise a gasket 50 that is made of any conventional material that is durable, pliable, moldable and water resistant such as rubber or plastic. An overflow pipe 60 is attached to the top portion 22 of the base 20. The overflow pipe is attached or connected by any conventional attachment means such as welding, gluing, epoxying or could also be integrally molded therewith should the stopper mechanism 10 be formed of a strong, durable material such as metal, rubber or plastic. In the preferred embodiment, the overflow pipe 60 is made of plastic or PVC pipe and is glued to the top portion 22 of the base 20 which is also made of plastic having the gasket 50 formed of rubber. The bottom 62 of the overflow pipe 60 is connected to the top portion 22 of the base and the top 64 of the overflow pipe 60 has a handle 66 connected to or integrally formed therewith and which makes insertion, removal and transportation of the stopper mechanism 10 easy and convenient. The overflow pipe 60 is tubular in shape and the preferred embodiment has a circular cross-section however any conventional geometric shape could be shown in cross-section such as, but not limited to, triangular, square, rectangular or diamond shaped. The top 64 of the overflow pipe is open and the overflow pipe 60 is hollow. The hollow opening of the overflow pipe 60 extends down through the base 20 making the hollow tube shape extend from the top 64 of the overflow pipe, through the base 20 to the bottom of the base 20 so that water can flow through the stopper mechanism 10 and down through the drain opening 30 in the toilet bowl 40 when the stopper mechanism 10 is in place in a toilet bowl 40. At the bottom 62 of the overflow pipe 60, at least one on each side, is a connecting means such as a hinge 100 for attaching arms 70 thereto. The arms 70 are attached by the hinge 100 to opposite sides of the overflow pipe 60. This upper portion 72 of each arm 70 is able to rotate away form the overflow pipe 60 and rest against or abut the rim 80 of the toilet bowl 40 when in use. Each arm 70 has a beveled or lower portion 76 so that the arm 70 will not come into interference or resistance by the top portion 22 of the base when the arm 70 is in the extended position (as shown in FIG. 3). The upper portion 72 of each arm 70 has a notch 74 so that the toilet bowl rim 80 will rest within the notch 74 and prevent the stopper mechanism 10 from moving when in use. At or near the top 64 of the overflow pipe 60 are at least two connecting means 90 such as spring clips, magnets, clamps or snapping mechanisms. In the preferred embodiment, a spring clip 90 is placed on opposite sides of the overflow pipe, each above and in alignment with each hinge 100. Each spring clip 90 is used to hold the top portion 72 of each arm 70 in place adjacent to the overflow pipe 60 when installing, removing and storing the stopper mechanism 10. The arm 70 slides or is snapped into place within the two retaining arms 102 of the spring clip and held in place until manually moved.

Figure 2:
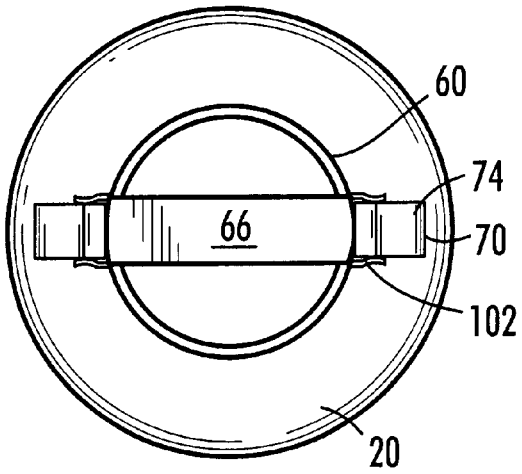
FIG. 2 is a top plan view thereof.

FIG. 2 is a top plan view of the stopper mechanism 10. The handle 66 extends across the center of the overflow pipe 60 and is connected to each and opposite sides of the overflow pipe 60. The handle 66 makes it easy for a person to hold, position, insert, extract and carry the stopper mechanism 10. FIG. 2 shows the arms 70 nestled within the retaining arms 102 of the spring clip 90. FIG. 2 also shows the overflow pipe 60 is hollow and open. The base 20 must be wider than the drain opening 30 in the toilet so that when placed within the toilet bowl 40, the stopper mechanism 10 will actually seal off the drain opening 30 to prevent water from escaping the toilet bowl 40.

FIG. 3 is a broken-away side elevation of the stopper mechanism 10 in use and in place within a toilet bowl 40. The gasket 50 of the base 20 is snugly placed within the drain opening 30 of the toilet bowl 40. The contoured fit of the gasket 50 prevents water from escaping the toilet bowl 40 down through the drain opening 30. The arms 70 are rotated, at the hinges 90, away from the overflow pipe 60 so the top portions 72 are adjacent the rim 80 of the toilet bowl 40. The rim 80 rests within the notches 74 of each arm 70 providing stability for the stopper mechanism 10. As the toilet bowl 40 fills with water, the stopper mechanisn 10 is prevented from moving around by the locking mechanism of the notch 74 and the rim 80. The top 64 of the overflow pipe 60 is the same height as the rim 80 of the toilet bowl 40. Therefore, when the water level 110 inside the toilet bowl 40 reaches the height of the rim 80 it will spill over the top 64 of the overflow pipe 60 and escape the toiled bowl 40 through the hollow center of the overflow pipe 60 and down through the drain opening 30 so the toilet bowl 40 will not overfill and overflow while the stopper mechanism 10 is in place.

When in use, the toilet is flushed and then the stopper mechanism 10, with the arms locked within the spring clip 90 is grasped by the handle 66 and placed within the toilet bowl 40 until the base 20 is in the bottom of the toilet bowl. The gasket 50 of the base 20 is nestled snugly into the drain opening 30. The arms 70 are then rotated at the hinges 100 outward and away from the top 64 of the overflow pipe 60 until they intersect with the rim 80 of the toilet bowl 40. In the fully extended position, the notch 74 of each arm 70 is fitted with the rim 80 of the toilet bowl 40 providing for the stopper mechanism to be snugly locked into one position and to be prevented from moving around within the toilet bowl 40. Also, by locking the arms 70 into place, the gasket 50 is pushed firmly into place creating a seal between the gasket 50 and the toilet bowl 40 thus preventing any liquid within the toilet bowl 40 from escaping through the drain opening 30. The toilet bowl 40 is then allowed to fill with water replenishing the toilet bowl 40 from the previous flushing action. As the water fills the toilet bowl 40, the water raises to the level of the top 64 of the overflow pipe 60. The water will continue to fill the toilet bowl 40 until it shuts off, that is, the float mechanism inside the back of the toilet causes the water to shut off or until it raises to the level of the top 62 of the overflow pipe 60. If the water does not shut off, it will flow into the hollow center of the overflow pipe 60 and exit the toilet bowl 40. When the toilet bowl 40 is full of water, a cleaning solution 120 is added to the toilet bowl 40 and allowed to sit for any desired amount of time. The inside of the toilet bowl 40 soaks with the cleaning solution 120 dissolving and loosening grime, dirt, germs, bacteria or mineral deposits that may have collected on the interior of the toilet bowl 40. After the desired time, a person may then scrub the inside of the toilet bowl 40 while it is still filled with water and cleaning solution 120, or the stopper mechanism 10 can be removed allowing the water and cleaning solution 120 to exit the toilet bowl 40 thus cleaning itself. To remove the stopper mechanism 10 from the toilet bowl 40, the arms 70 are rotated at the hinges 100 back so that they are adjacent to the overflow pipe 60 and they are then snapped into place in the spring clip 90 within the retention arms 102. The person then grasps the handle 66 and removes the stopper mechanism 10 from the toilet bowl 40 completely and stores it somewhere convenient until its next use.

The toilet bowl cleaning system described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A toilet bowl cleaning system comprising:

a) a stopper mechanism comprising:

i) a base having a top portion, a middle portion, and a bottom portion;

ii) said middle and said bottom portion comprising a gasket;

iii) an overflow pipe, connected to said base at said top portion and extending axially therefrom;

iv) a plurality of arms hingedly connected at a beveled lower portion thereof to said overflow pipe and having a notch at an upper portion thereof;

v) a plurality of spring clips attached to said overflow pipe for receiving and retaining said arms; and b) a cleaning solution wherein said stopper mechanism is placed within a toilet bowl and said cleaning solution is added to water within said toilet bowl.

2. The toilet bowl cleaning system of claim 1, further comprising:

a handle connected to said overflow pipe.

3. A method of cleaning a toilet bowl comprising the steps of:

providing a stopper mechanism having an overflow pipe connected to a base, said base having a gasket, at least two arms hingedly connected to said overflow pipe, each of said arms having a notch for abutting a rim of a toilet, a handle connected to said overflow pipe, for moving said stopper mechanism, springs clips for retaining said arms and cleaning solution;

flushing said toilet;

placing said stopper mechanism in said toilet bowl so that said gasket fits within a drain in the toilet bowl;

rotating said arms away from said overflow pipe until said notches abut said rim of said toilet bowl;

allowing said toilet bowl to fill with water;

adding said cleaning solution to said water;

allowing said water to stand in said toilet bowl for a period of time;

rotating said arms toward said overflow pipe until they are within said spring clip;

removing said stopper mechanism from said toilet bowl; and flushing said toilet;

wherein said steps comprise cleaning said toilet bowl.

* * * * *